US006009816A

United States Patent [19]

Wendel

[11] Patent Number: 6,009,816

[45] Date of Patent: Jan. 4, 2000

[54] MODULAR FURNITURE ASSEMBLY

[75] Inventor: Christopher M. Wendel, Westfield, N.J.

[73] Assignee: ExhibitGroup/Giltspur, Inc., Ill.

[21] Appl. No.: 08/388,573

[22] Filed: Feb. 14, 1995

[51] Int. Cl.[7] ..... A47B 3/06

[52] U.S. Cl. ..... 108/157.17; 108/153.1

[58] Field of Search ..... 100/157.1, 153.1, 100/193, 192, 180; 312/265.5, 263, 264, 195; 108/157.17

[56] References Cited

U.S. PATENT DOCUMENTS

| | | | |
|---|---|---|---|
| 426,231 | 4/1890 | Bosworth | 108/157 X |
| 3,837,721 | 9/1974 | Manlove et al. | 312/265.5 X |
| 4,288,136 | 9/1981 | Le Mer | 312/265.5 X |
| 4,371,221 | 2/1983 | Citterio | 312/264 X |
| 4,750,794 | 6/1988 | Vegh . | |
| 4,869,564 | 9/1989 | Lechman . | |
| 4,883,331 | 11/1989 | Mengel . | |
| 4,886,326 | 12/1989 | Kuzyk . | |
| 4,951,576 | 8/1990 | Cobos et al. | 108/901 X |
| 5,372,415 | 12/1994 | Tisbo et al. | 312/263 X |
| 5,382,088 | 1/1995 | Young | 312/265.5 X |
| 5,454,331 | 10/1995 | Green | 108/193 X |
| 5,460,564 | 10/1995 | Bowes et al. | 312/265.5 X |

FOREIGN PATENT DOCUMENTS

| | | | |
|---|---|---|---|
| 573065 | 2/1958 | Italy | 312/265.5 |

*Primary Examiner*—Jose V. Chen
*Attorney, Agent, or Firm*—Joseph H. Roediger

[57] ABSTRACT

A modular furniture assembly of the knock-down type wherein four identical side panels are interengaged at corner lap joints to facilitate set tip and take-down. Each panel has fasteners located on one edge and on the interior surface panel proximate to the opposing edge. The resultant structure is square in cross section. A square closure member forms the top surface.

9 Claims, 2 Drawing Sheets

FIG. 1
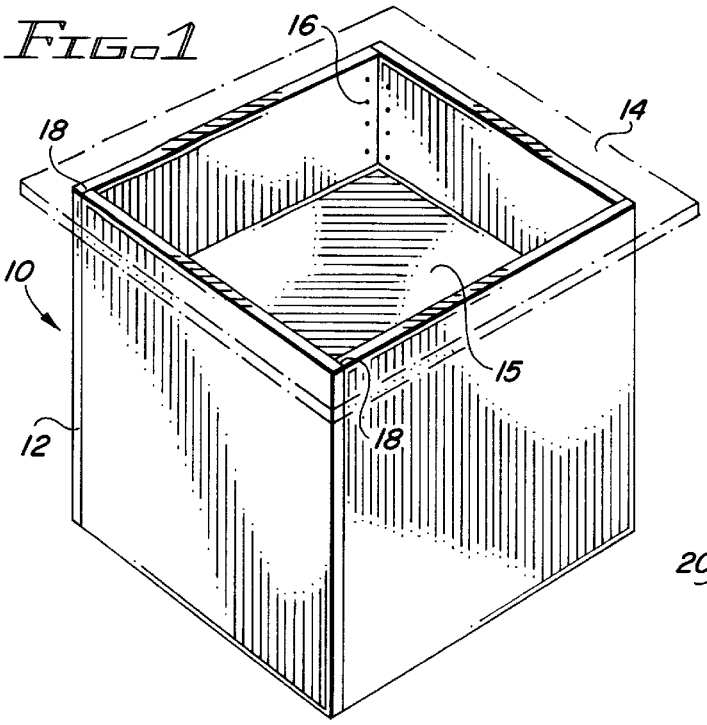
FIG. 3
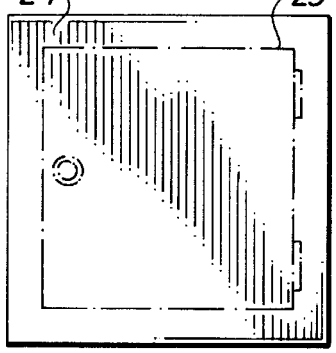
FIG. 4
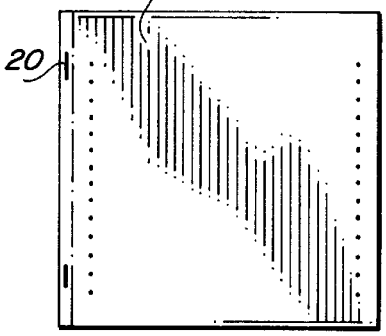
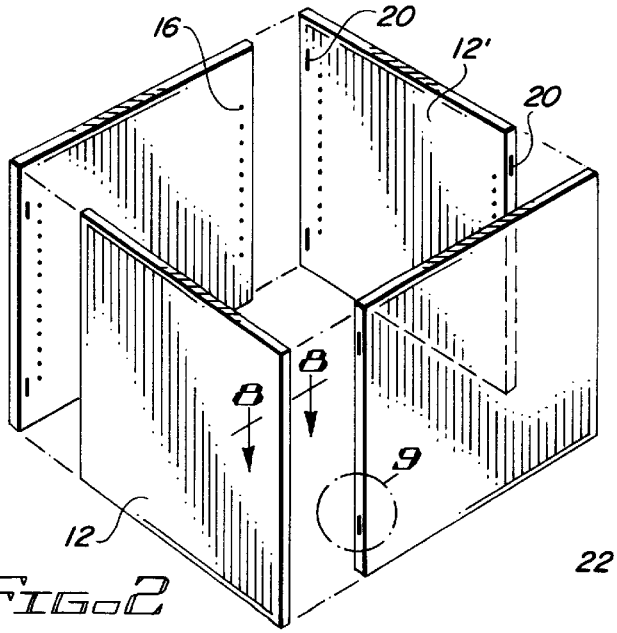
FIG. 2
FIG. 5
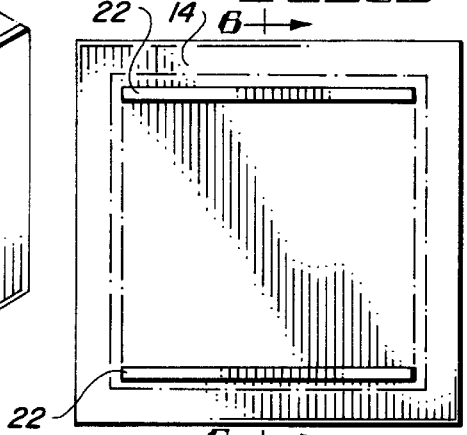
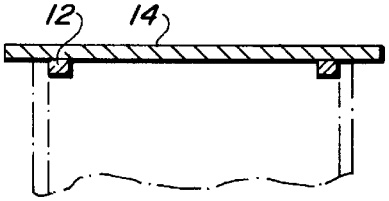
FIG. 6
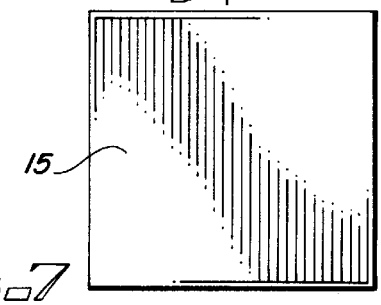
FIG. 7

MODULAR FURNITURE ASSEMBLY

BACKGROUND OF THE INVENTION

This invention relates to modular furniture of the type used for temporary exhibition or display purposes and, in particular, to a novel base or cabinet formed of four (identical) panels interengaged by the use of lap joints which facilitates rapid assembly.

The use of non-permanent structural assemblies and display furnishings in exhibition spaces is ever increasing due in part to the large number of trade shows and conventions being held each year to stimulate interest in the products and services of exhibitors. To attract trade show and convention business to cities, the cities must not only have suitable lodging facilities and amenities, but also a large area exhibition hall or convention center. The large area is typically leased in small parcels to users who define and create a workplace according to their own requirements. Whether the exhibitors or the staff of the facility deploy the spaced dividers and the furnishings, the objective is to provide an attractive and functional place in which to conduct business at a minimum cost for a short period of time. The costs associated with the use of the leased facilities require that assembly and disassembly of the furnishings be accomplished in a short period of time, normally with unskilled labor. Additionally, the costs associated with shipping fully assembled empty cabinets have created the need for knock-down cabinetry to more fully utilize the carrying capacity of shipping containers.

In practice, modular furniture used in exhibitions and trade shows utilizes a multiplicity of different-sized panels and fixtures which employ a variety of locking devices. The locking devices range from the simple pin and receiving hole to mechanical interlocks wherein two identical fasteners are affixed to adjacent pieces and become interengaged by insertion one to the other followed by lateral movement. In some cases, the panels used to form the furniture contain slots or notches to receive fastening devices while in other applications the panels have the fastening devices affixed thereto. The major portion of the time involved in assembling the modular furnishings is used to segregate, identify and orient the individual parts prior to initiating assembly. The more unique are the parts involved in the article of furniture, the longer it takes to assemble it using unskilled labor. Furthermore, with a variety of different-sized parts using interchangeable fastening devices, the problem of misassembly arises. It is not uncommon for the workers to have partially assembled an article of furniture only to find that an incorrect part has been affixed to the partial assembly. This situation also increases the time involved and the ultimate cost of set-up of the furnishings. In addition, the use of different size parts in display furnishings requires that a number of spare parts be kept in inventory in case of damage. These parts have to be on hand at the time of assembly and either stored or removed from the site following assembly.

Typically, ready to assemble display furnishings utilize a multiplicity of modular panels joined together through the use of a variety of locking devices. The furnishings include a number of different sized panels and separate brackets or hinges to affix panels one to another. The presently known arrangements suffer from a variety of deficiencies which limit the usefulness of such arrangements. One problem results from the fact that when panels of different sizes are used to create the most elemental of furnishings, the cabinet base receives a larger area horizontal workplace or display surface which has to be oriented to the particular cabinet base. The need for initially classifying the different sized panels used in the assembly of the base adds time to the assembly task. Another disadvantage is the requirement that many systems have a need for end posts or elaborate columns which add an additional step to assembly. Also, the connecting hardware in many of these furnishings is not affixed to the panels, but requires separate installation while coping with the need to properly orient adjacent panels. This problem is most acute during the initial assembly step when panels are not interconnected and are not free standing. In the event that assembly is begun without properly recognizing the sequence of assembly or the different-sized panels have been improperly classified, the need to disassemble the panels and restart the process adds considerably to the time required to complete assembly. All of these factors are exacerbated by the fact that unskilled workers are frequently employed to complete these tasks. As a result, the costs of set-up and take-down are increased.

Several different types of ready-to-assembly or knock-down furniture have been described in the prior art. For example, U.S. Pat. No. 4,750,794 describes the use of mortise and tenon interconnections to form a box-like structure for use as a base cabinet. The cabinet in its most elemental form requires the use of three different sized panels in assembling the structure. Assembly is effected by sliding the parts into position utilizing the mortise grooves as guides. This structure has the advantage of not requiring additional fasteners. Other approaches such as that shown in U.S. Pat. Nos. 4,154,492, 4,886,326, and 4,869,564 all describe interlock systems for ready-to-assemble furniture utilizing a variety of independent and distinct fastening devices. Another approach to providing easily erected modular furniture is disclosed in U.S. Pat. No. 4,883,331 wherein aligning means such as a pin and socket are combined with hook and loop coupling material to removably secure the panels used in creating modular furnishings. The foregoing references utilize a number of different sized pieces in forming the subject article utilizing the traditional butt joint at both ends of the smaller panel. As a result, the installer must classify fronts and backs and segregate those from the side panels. If the fastening means are separate, the installer must prop two panels while he affixes one to the other which can be awkward in the case of larger displays wherein the panels are formed of wood and can be relatively heavy. While two men can be used to initiate the assembly process, this greatly adds to the labor component and unduly increases the cost of both set-up and take-down.

Accordingly, the present invention is directed to a modular base or cabinet for use in connection with portable displays and exhibitions and for supporting semi-permanent work surfaces wherein the individual panels of the cabinet structure can be rapidly and easily interchanged to facilitate assembly. The versatility of the modular cabinet of the present invention is due primarily to the use of overlapping or lap joints for each panel which enables the side, back and front panels to have the same width dimension. The fasteners are attached to the panels so that the installer need not cope with locating the appropriate fastener and affixing it to two adjacent panels. As a result, the modular cabinets can be quickly erected to form the support units for work surfaces and the work surfaces themselves can be installed without regard to orientation. The resultant base or cabinet structure is preferably square in cross section with four identical panels so that the overlying work surface, also formed as a square with guides on its lower surface, is received in the structure without having to first locate a front or back edge.

Since a primary object of the present invention is to provide a light weight base or cabinet structure that can be rapidly assembled, the present invention utilizes panels made of a laminate structure containing an expanded plastic or foam core within a frame. The outer surfaces of the core are formed of rigid plastic sheet material which can accommodate an overlying decorative layer if desired. The fastening or engaging means for adjacent panels is installed during manufacture so that only two hands are required to interengage the first two panels and all subsequent panels of the assembly. The elimination of separate structural fasteners such as end posts permits a series of modular base units or cabinets to be adjacently disposed and provide a continuous surface unbroken by sections of different materials.

SUMMARY OF THE INVENTION

The present invention is directed to a cabinet stand assembly for rapid set-up and take-down for use in exhibitions and display environments. The assembly includes at least four panels with each panel having a pair of opposing edges and a pair of opposing large area surfaces extending therebetween. Opposing panels have equal width dimensions and are generally interchangeable. The panels contain releasable fasteners which enable lap joints to be used for the interengagement of adjacent panels to form the cabinet stand assembly.

A first releasable fastener is affixed to one of the pair of edges, termed the engaging edge, of each panel. As a result, the first releasable fastener is positioned to receive an adjacent fastener urged in a direction parallel to the large area surface of the panel. A second releasable fastener is affixed to the large area surface of each panel spaced inwardly and proximate to the other of the pair of edges. The first and second fasteners releasably engage each other upon contact to form an overlapping configuration which includes four lap joints in the completed assembly. The interengagement of four identical panels provides a square cross-section cabinet stand assembly having equal width sides.

The work surface which forms the top member of the novel cabinet stand assembly is provided with a pair of spaced alignment guides affixed to the underside thereof. Since the cabinet stand assembly is normally square in cross section, the orientation of the member is not important to the installer. In applications where the cabinet stand assembly is used solely for support of the work surface member, all four sides are identical in dimension and fastener location. The person making the assembly need not preclassify the panels before beginning assembly. As a result, assembly is normally accomplished without misplacement of a panel and proceeds to its conclusion without mistakes being made which would otherwise require disassembly and restarting the process.

The panels are fabricated with a foam core bounded on the perimeter by rigid frame members to allow for the insertion of fasteners and the attachment of hardware. The use of the light weight core decreases the overall weight of each panel making it easier to manipulate during engagement of the fastening means. Since the fastening means are affixed to the panels, the workers hands are free to orient the panels correctly without requiring installation of individual connectors. The objective of the invention is to provide the assembler with the opportunity to accomplish set-up and take-down in the shortest practical period of time. The present invention also reduces the need to inventory a host of different panels and fastening means in case of damage thereby reducing storage and handling costs.

Further features and advantages of the invention will become more readily apparent from the following detailed description of a specific embodiment of the invention when taken in conjunction with the accompanying drawings.

BRIEF DESCRIPTION OF THE DRAWINGS

FIG. 1 is a view in perspective showing the cabinet stand assembly with the top member in outline form.

FIG. 2 is an exploded view showing the base of the cabinet stand assembly.

FIG. 3 is a plan view of a panel having an optional door therein.

FIG. 4 is a plan view of the interior surface of a panel.

FIG. 5 is a bottom view of the top member.

FIG. 6 is a cross-sectional view of the top member of FIG. 5.

FIG. 7 is a plan view of a shelf for the assembly.

DESCRIPTION OF THE PREFERRED EMBODIMENT

Figure 8:
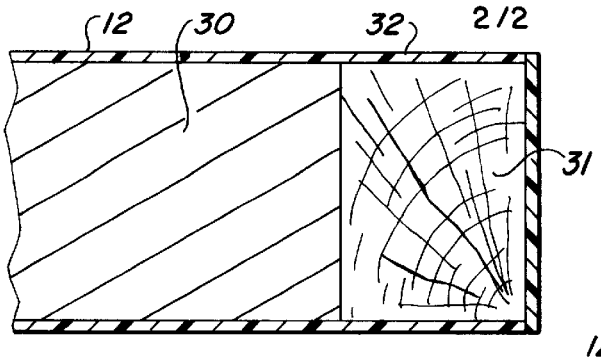
FIG. 8 is a partial cross sectional view of a panel.

Referring now to FIG. 1, the cabinet stand assembly which is the subject of the present invention is shown comprised of four panels 12 interengaged to form an assembly base 10. A top closure member 14 is shown in outline form. In addition, a drop-in shelf 15 which is optional is shown within the assembly base. A plurality of holes 16 are provided along the vertical edges of each panel to support conventional hanger clips for drop-in shelving.

The four panels are interengaged in overlapping configuration at each corner wherein the engaging edge portion of a panel is placed against the inside surface of an adjacent panel with the opposing edge portion forming part of the exterior surface of the assembly base 10. The four lap joints 18 are identical in the assembly base structure.

In FIG. 2, the assembly base 10 is shown in exploded form with the placement of the releasable catches on each panel being identical. In particular, panel 12 has two releasable fasteners 20 affixed to one engaging edge and positioned equidistance from the panels horizontal center line. Another pair of releasable fasteners is affixed to the large area interior surface of panel 20' proximate to the opposing edge also equidistant from the horizontal center line. The placement of the releasable fasteners enables the panel configuration for the cabinet assembly base 10 to be formed using the corner lap joints as shown in FIG. 1. As a result, each panel 12 is made with the same height and width dimensions and is therefore interchangeable with other panels. During the assembly of the base 10, the workman need not classify the different panels prior to assembly. Installation of the fasteners of one panel into the receiving fasteners of an adjacent panel is the same for each of the four panels 12. Consequently, it is unlikely that any errors will occur during assembly and the possibility of having to disassemble a partially completed assembly is remote.

The interior surface of the panel 12 is shown in FIG. 4 wherein a pair of releasable fasteners 20 are affixed to the left hand engaging edge of the interior surface. As shown, optional holes 16 for receiving hanger clips to support drop-in shelving are placed in parallel alignment near the opposing edge portions of the panel. The use of shelves is optional and requires the use of a panel 24 having a central opening 25 therein as shown in FIG. 3. A door can be mounted in the panel by use of recessed hinges which are shown in outline form.

The assembly of the present invention is further simplified for the workforce since the square cross sectional area accommodates a top closure member as shown in FIGS. 5 and 6. The closure member 14 is provided with alignment guides 22 on its underside and the closure member may be placed on the base 10 without regard to orientation since the cross sectional area of the base is square. A typical square drop-in shelf 15 is shown in FIG. 7.

The panels used to form the cabinet assembly are preferably constructed as shown in the cross sectional view of FIG. 8. The central portion of panel 12 is formed of an expanded foamed plastic core 30 which is bounded on either side by rigid plastic layer 32. The panels are framed with wood around the perimeter of the foamed plastic core. The wood from provides a solid substrate for the attachment of the fasteners. A plastic protective layer 32 is preferably adhered to the outer surface of the members of the panel and is also used to cover the exposed edges of the panel as shown. By utilizing the foam core, the panels and the assembled cabinet base are relatively light as compared to the weight of conventional solid plywood or hardboard panels used in knock-down display furnishings.

Figure 9:
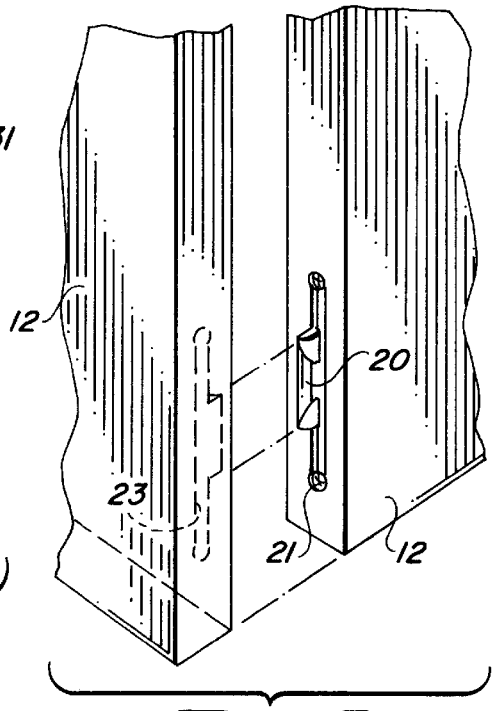
FIG. 9 shows a typical engaging device in adjacent panels.
Figure 10:
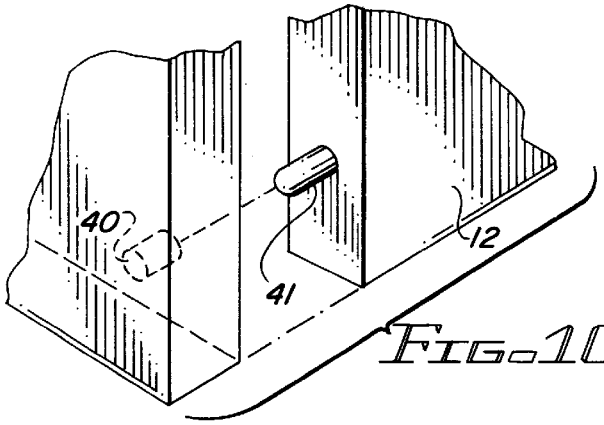
FIG. 10 shows an alternate engagement device for adjacent panels.

An embedded releasable fastener is shown in FIG. 9 affixed to a slot formed in the edge portion of panel 12. The fastener 20 is held in position in the slot by screws 21 which extend into the panel frame. The fastener includes a central portion which extends outwardly from the slot and has spaced raised portions thereon. A similar slot 23 is formed in the adjacent panel and includes a like fastener. These commercial fasteners releasably engage one another by inserting the central portions in the slots while the panels are slightly vertically misaligned. When moved into alignment, the raised portions are located adjacent to each other and firm engagement takes place. While the recessed mechanical fasteners are shown in FIG. 9, the use of a combination of tapered pegs and holes can be utilized as well. For example, in FIG. 10, panel 12 contains a dowel 41 and the adjacent panel includes a receiving hole 40. When inserted, frictional engagement between peg and hole secures the adjacent panels in alignment one to the other. It is to be noted that a variety of commercial fasteners can be utilized as long as they do not prevent the overlapping panels from resting adjacent to each other when assembled.

Figure 11:
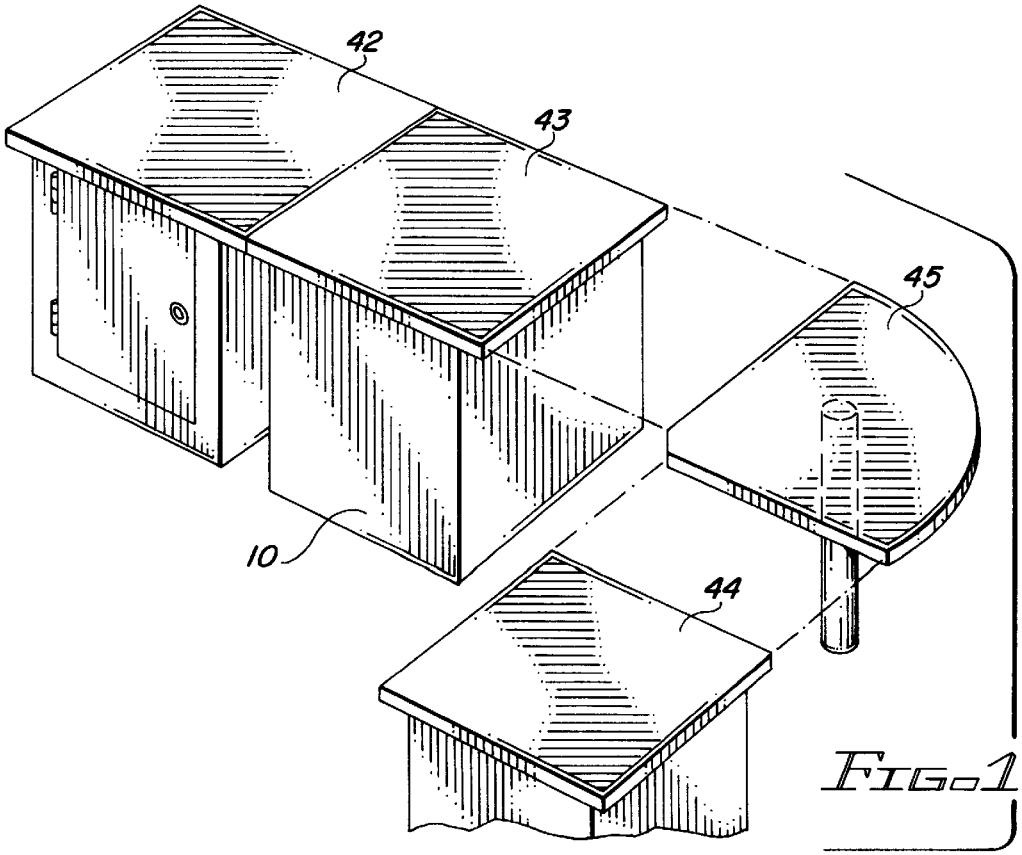
FIG. 11 is a view in perspective of a plurality of cabinet stand assemblies constructed in accordance with the present invention.

An assembled cabinet base is provided with a top closure member, normally square in form which can be utilized with like assemblies to form a display array as shown in FIG. 11 wherein the top closure members 42 and 43 abut each other. Each of the top closure members can be provided with hook and loop type fasteners such as 3M Dualock on its vertical edges so that the interengagement of adjacent top members ensures that alignment can be maintained during use. A corner top member 45 with a curved outer edge is shown supported by a pedestal 40. The corner member enables a safe display area to be provided without having any sharp angles at the exposed corner of the work surface. As shown, the change in direction enables additional assemblies to be attached by moving top member 44 into engagement with the exposed vertical edge of the corner member.

The use of the foam core and frame in combination with the rigid plastic exterior layers provides light weight cabinet base assemblies characterized by four lap joints at the corners which can be moved readily into position to form a variety of display structures. The disassembly or take-down of display furnishings utilizing one or more of the novel cabinet base assemblies is relatively simple and can be handled by one workman. The disassembled parts need not be classified as to different sized panels since all are of the same dimensions in the preferred embodiment shown in the drawings. The shape of the embodiment shown is square in cross-sectional area and other shapes using the lap joint construction can be formed by utilizing pairs of opposing panels having different widths.

While the above description has referred to preferred embodiments of the invention, it is to be noted that many modifications and variations may be made therein without departing from the scope of the invention as claimed.

I claim:

1. A cabinet stand assembly for rapid set-up and take down which comprises:

a) four panels with each panel of the same width having a pair of opposing edges and a pair of opposing large area surfaces extending between said edges;

b) a first releasable fastener affixed to one of said pair of opposing edges of each panel; and c) a second releasable fastener affixed to a large area surface of each of said panels proximate to the other of said pair of opposing edges, said first and second fasteners releasably engaging each other upon contact therebetween, the placement of said four panels in alternate overlapping edge configuration whereby adjacent first and second fasteners interengage forming a cabinet stand assembly of equal width sides.

2. The invention in accordance with claim 1 further comprising a pair of first releasable fasteners affixed to one of the edges of each panel, and a pair of second releasable fasteners affixed to the large area surface of each panel and positioned to receive a pair of first releasable fasteners.

3. The invention in accordance with claim 2 further comprising a top closure member having top and underside surfaces and a pair of spaced alignment guides affixed to said underside surface.

4. The invention in accordance with claim 3 wherein said at least four panels includes one panel having an opening therein to provide access to the interior of the cabinet.

5. The invention in accordance with claim 3 wherein said panels are four in number and have equal width dimensions whereby the cross-sectional area of the cabinet is square.

6. The invention in accordance with claim 5 wherein the top closure member is square.

7. The invention in accordance with claim 6 wherein the top closure member is provided with vertical edges and further comprises fastening means affixed to a vertical edge for releasable engagement with an adjacent cabinet.

8. The invention in accordance with claim 2 wherein said panels are formed of a laminate wherein a central section of foamed plastic is bounded by rigid frame members.

9. The invention in accordance with claim 8 wherein said panels are provided with a protective layer.

* * * * *